US007316228B2

(12) United States Patent
Maegawa et al.

(10) Patent No.: US 7,316,228 B2
(45) Date of Patent: Jan. 8, 2008

(54) EVAPORATED FUEL TREATMENT SYSTEM FOR INTERNAL COMBUSTION ENGINE

(75) Inventors: Yoshinori Maegawa, Obu (JP); Toshiki Annoura, Nagoya (JP)

(73) Assignee: Denso Corporation, Kariya, Aichi-pref (JP)

( * ) Notice: Subject to any disclaimer, the term of this patent is extended or adjusted under 35 U.S.C. 154(b) by 0 days.

(21) Appl. No.: 11/706,405

(22) Filed: Feb. 15, 2007

(65) Prior Publication Data

US 2007/0199548 A1 Aug. 30, 2007

(30) Foreign Application Priority Data

Feb. 27, 2006 (JP) ..... 2006-051176

(51) Int. Cl.
*F02B 75/08* (2006.01)
*F02M 33/02* (2006.01)

(52) U.S. Cl. ..... 123/698; 123/520

(58) Field of Classification Search ..... 123/518, 123/519, 520, 521, 516, 698
See application file for complete search history.

(56) References Cited

U.S. PATENT DOCUMENTS 5,111,796 A * 5/1992 Ogita ..... 123/520
5,150,686 A * 9/1992 Okawa et al. ..... 123/698
5,230,319 A * 7/1993 Otsuka et al. ..... 123/520
5,313,925 A * 5/1994 Otsuka et al. ..... 123/520
5,732,689 A * 3/1998 Ohno et al. ..... 123/673
5,775,307 A * 7/1998 Isobe et al. ..... 123/520
5,826,566 A * 10/1998 Isobe et al. ..... 123/520
6,047,692 A * 4/2000 Toyoda ..... 123/698
6,971,375 B2 12/2005 Amano et al.
2006/0042605 A1 3/2006 Amano et al.

FOREIGN PATENT DOCUMENTS

JP 05-018326 1/1993

* cited by examiner

*Primary Examiner*—John T. Kwon
(74) *Attorney, Agent, or Firm*—Nixon & Vanderhye P.C.

(57) ABSTRACT

In an evaporated fuel treatment system, a pump is operated to flow air through a specified restriction and a sensor detects a first differential pressure across the restriction. A fuel tank, a canister, and the restriction are made to communicate with each other and an air-fuel mixture containing the evaporated fuel is purged from the canister. The mixture flows through the restriction and a second differential pressure across the restriction is detected. A differential pressure ratio and an evaporated fuel concentration used for the control of a flow rate are computed from these differential pressures. When fuel swings in a period during which the second differential pressure is detected, the pressure difference ratio is not computed and the flowrate control of the air-fuel mixture is not conducted.

16 Claims, 13 Drawing Sheets

EVAPORATED FUEL TREATMENT SYSTEM FOR INTERNAL COMBUSTION ENGINE

CROSS-REFERENCE TO RELATED APPLICATION

This application is based on Japanese Patent Application No. 2006-51176 filed on Feb. 27, 2006, the disclosure of which is incorporated herein by reference.

FIELD OF THE INVENTION

The present invention relates to an evaporated fuel treatment system for an internal combustion engine.

BACKGROUND OF THE INVENTION

An evaporated fuel treatment system prevents the dissipation of evaporated fuel produced in a fuel tank to the atmosphere. The evaporated fuel in the fuel tank is introduced into a canister having an adsorbing material and is temporarily adsorbed by the adsorbing material. The evaporated fuel adsorbed by the adsorbing material is desorbed by a negative pressure developed in an intake pipe when an internal combustion engine is operated and is purged to the intake pipe of the internal combustion engine through a purge passage. When the evaporated fuel is desorbed from the adsorbing material in this manner, the adsorption capacity of the adsorbing material is recovered.

When the evaporated fuel is purged, the flow rate of an air-fuel mixture containing the evaporated fuel is controlled by a purge control valve disposed in the purge passage. However, in order to control the quantity of evaporated fuel actually purged to the intake pipe to an appropriate air-fuel ratio by the purge control valve, it is important to measure the concentration of the evaporated fuel in the air-fuel mixture flowing in the purge passage with high accuracy.

JP-5-18326A shows a system in which mass flow meters are disposed in a purge passage and an atmosphere passage branched from the purge passage. The concentration of evaporated fuel in an air-fuel mixture supplied to an intake pipe of an internal combustion engine from the purge passage is detected on the basis of the output values of the two mass flow meters.

However, the flowmeter is disposed in the purge passage in this system, so the concentration of the evaporated fuel cannot be detected unless the air-fuel mixture containing the evaporated fuel is purged and flows in the purge passage. In order to reflect the detected concentration of the evaporated fuel in the control of an air-fuel ratio, it is necessary to measure the concentration of evaporated fuel before the purged evaporated fuel reaches the injector position. It is necessary to correct the amount of fuel to be injected from the injector based on the measured concentration of evaporated fuel.

However, in the case of an engine having a small intake pipe volume or in an operation range of a high flow velocity of intake air, the time required for purged evaporated fuel to reach the injection position is shorter than the time required for completing the measurement of an evaporated fuel concentration. Thus, it may be impossible to reflect a measured evaporated fuel concentration. Therefore, an engine structure including the layout of pipes and the operation range of starting purge may be restricted.

It can be thought as means for solving the above problems that an air-fuel mixture containing air and evaporated fuel is flowed through a restriction to detect the amount of change in the pressure of air caused by the restriction and the amount of change in the pressure of the air-fuel mixture caused by the restriction. The flow rate of the air-fuel mixture introduced into an intake pipe of an internal combustion engine from a canister is controlled on the basis of the amounts of change in the two amounts of change in pressure.

The amount of change in the pressure caused by the restriction is changed by the density of fluid flowing through the restriction, as is known as Bernoulli's theorem. The amount of change in the pressure when gas containing 0% evaporated fuel (that is air) of a reference gas is flowed through a restriction is compared with the amount of change in the pressure when an air-fuel mixture containing evaporated fuel is flowed through the restriction. A difference in density between both gases can be detected. This difference in density corresponds to the evaporated fuel concentration of the air-fuel mixture. Thus, the evaporated fuel concentration of the air-fuel mixture can be known on the basis of the two amounts of change in pressure (refer to U.S. Pat. No. 6,971,375B2).

When an evaporated fuel concentration is computed on the basis of the amount of change in pressure caused by a restriction, it is preferable that the amount of change in pressure caused by the restriction is changed only by the evaporated fuel concentration of the air-fuel mixture and is not changed by other conditions.

However, the fuel tank always communicates with the canister and hence the canister communicates with the restriction in a state in which the amount of change in pressure caused by the restriction is measured. Thus, when pressure in the fuel tank is changed due to a swing of fuel in the fuel tank, the variation in pressure propagates to the restriction. This variation in pressure is detected by a pressure sensor. For this reason, there is a possibility that when fuel swings, the amount of change in pressure caused by the restriction is changed. Moreover, when the fuel tank communicates with the restriction also in a state in which the amount of change in pressure of air, caused by the restriction, is measured, there is a possibility that the amount of change in the pressure of air, caused by the restriction, is changed by the swing of fuel. When the amount of change in the pressure of the air-fuel mixture or air, caused by the restriction, is changed by the swing of fuel, the accuracy of controlling the flow rate of the air-fuel mixture is lowered to increase the amount of deviation of the air-fuel ratio from the stoichiometric air-fuel ratio.

The present invention has been accomplished in view of these circumstances. An object of the present invention is to provide an evaporated fuel treatment system that can control the flow rate of an air-fuel mixture introduced into an intake pipe with higher accuracy.

SUMMARY OF THE INVENTION

The evaporated fuel treatment system for an internal combustion engine according to the present invention includes a first pressure detection means for detecting an amount of change in pressure of an air-fuel mixture caused by a specified restriction in a first measurement state. In the first measurement state, the fuel tank, the canister, and the restriction communicate with each other and the air-fuel mixture flows through the restriction. The system includes a flow rate control means for controlling a flow rate of the air-fuel mixture introduced into the intake pipe from the canister on a basis of an amount of change in pressure detected by the first pressure detection means and an amount of change in pressure of air flowing through the specified restriction. The system includes a fuel swing determination means for determining whether fuel in the fuel tank swings. When the fuel swing determination means determines that the fuel swings, the flow rate control means stops the control of a flow rate of the air-fuel mixture based on an amount of change in pressure of the air-fuel mixture.

When the fuel swing determination means determines that fuel swings, the flow rate control means does not control the flow rate of the air-fuel mixture on the basis of the amount of change in the pressure of the air-fuel mixture which is caused by the restriction and detected by the first pressure detection means. For this reason, it is possible to prevent the flow rate of the air-fuel mixture from being controlled on the basis of the amount of change in the pressure of the air-fuel mixture which is of insufficient accuracy due to the swings of fuel. As a result, it is possible to control the flow rate of the air-fuel mixture introduced into the intake pipe with higher accuracy.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF THE PREFERRED EMBODIMENTS

Figure 1:
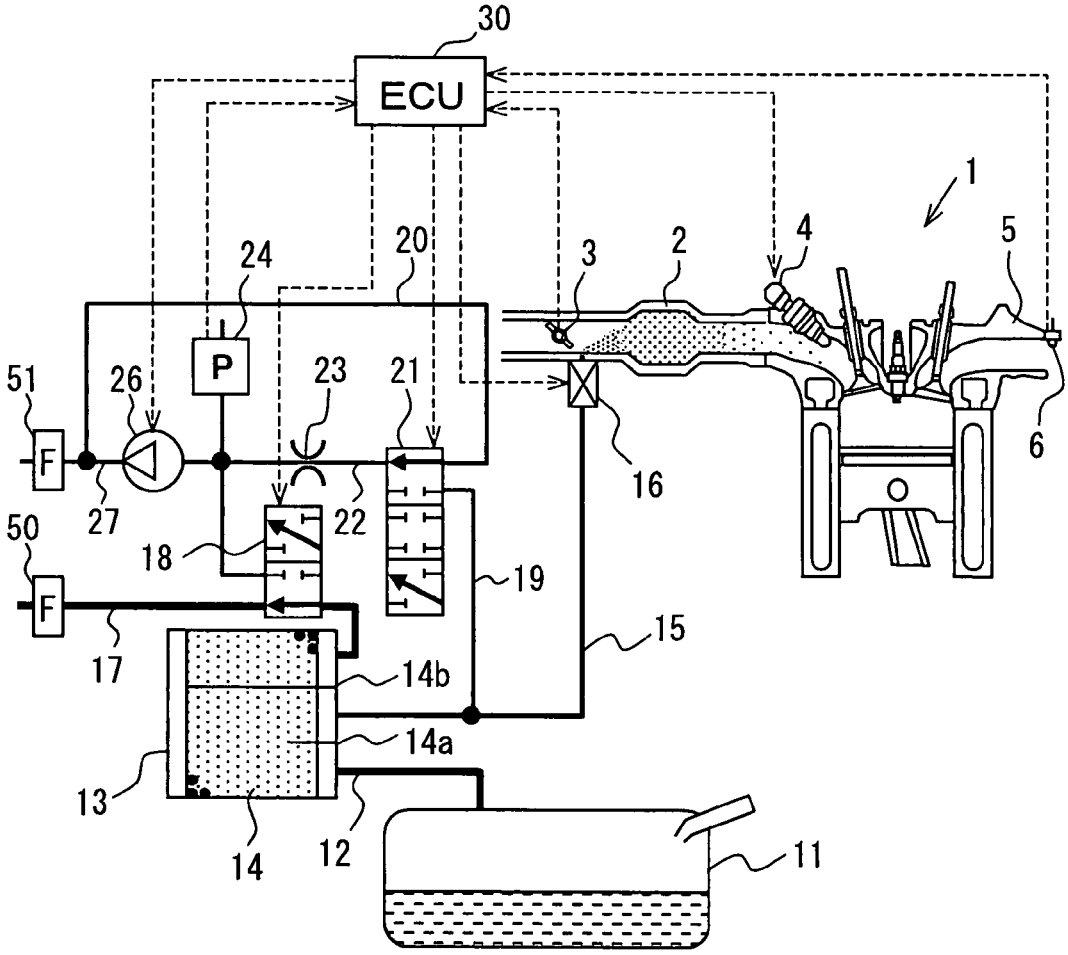
FIG. 1 is a construction diagram showing the construction of an evaporated fuel treatment system according to an embodiment of the present invention.

The preferred embodiments of the present invention will be described below. FIG. 1 is a construction diagram showing the construction of an evaporated fuel treatment system according to the present invention. The evaporated fuel treatment system according to the present invention is applied to the engine of an automobile, for example, and a fuel tank 11 of an engine 1 of an internal combustion engine is made to always communicate with a canister 13 via an evaporation line 12 of a vapor introduction passage.

The canister 13 is packed with an adsorbing material 14 and evaporated fuel produced in the fuel tank 11 is temporarily adsorbed by the adsorbing material 14. The canister 13 is connected to an intake pipe 2 of the engine 1 via a purge line 15 of a purge pipe. The purge line 15 is provided with a purge valve 16 of a purge control valve and when the purge valve 16 is opened, the canister 13 communicates with the intake pipe 2.

Partition plates 14*a* and 14*b* are disposed in the canister 13. The partition plate 14*a* is disposed between the connection position of the evaporation line 12 and the connection position of the purge line 15 and prevents evaporated fuel introduced from the evaporation line 12 from being purged from the purge line 15 without being adsorbed by the adsorbing material 14.

An atmosphere line 17 is also connected to the canister 13. The other partition plate 14*b* is disposed between the connection position of the atmosphere line 17 and the connection position of the purge line 15 in the substantially same depth as the packing depth of the adsorbing material 14. This prevents the combustion vapor introduced from the evaporation line 12 from being purged from the atmosphere line 17.

The purge valve 16 is a solenoid valve and has its opening controlled by an electronic control unit (ECU) 30 for controlling the respective parts of the engine 1. The flow rate of an air-fuel mixture containing evaporated fuel flowing in the purge line 15 is controlled by the purge valve 16. The air-fuel mixture having its flow rate controlled is purged into the intake pipe 2 by a negative pressure developed in the intake pipe 2 by a throttle valve 3 and is combusted together with fuel injected from an injector 4 (hereinafter, an air-fuel mixture containing the purged evaporated fuel is referred to as purge gas).

The atmosphere line 17 is open to the atmosphere via a filter 50 is connected to the canister 13. The atmosphere line 17 is provided with a selector valve 18. The selector valve 18 switches between two positions. In one position, the canister 13 communicates with the atmosphere line 17. In the other position, the canister communicates with the suction of a pump 26. Here, when the selector valve 18 is not operated by the ECU 30, the selector valve 18 is set at a first position in which the canister 13 communicates with the atmosphere line 17. When the selector valve 18 is operated by the ECU 30, the selector valve 18 is switched to a second position in which the canister 13 communicates with the suction side of the pump 26.

A branch line 19 branched from the purge line 15 is connected to one input port of a three-position valve 21. Moreover, an air supply line 20 branched from a discharge line 27 of the pump 26 is connected to the other input port of the three-position valve 21. The discharge line 27 is opened to the atmosphere via a filter 51. A measurement line 22 of a measurement passage is connected to an output port of the three-position valve 21.

The three-position valve 21 is switched by the ECU 30 between a first position in which the air supply line 20 is connected to the measurement line 22, a second position in which both connections of the air supply line 20 and the branch line 19 to the measurement line 22 are interrupted, and a third position in which the branch line 19 is connected to the measurement line 22. Here, when the three-position valve 21 is not operated, the three-position valve 21 is set at the first position.

The measurement line 22 is provided with a restriction 23 constructed of an orifice and the pump 26. The pump 26 is an electrically operated pump and introduces gas into the measurement line 22 when it is operated. The pump 26 is turned ON or OFF and has the number of revolutions controlled by the ECU 30. When the ECU 30 operates the pump 26, the ECU 30 controls the pump 26 so as to hold the number of revolutions constant at a previously set specified value.

Thus, when the ECU 30 operates the pump 26 in a state where the three-position valve 21 is set at the third position, there is brought about "a first measurement state" where an air-fuel mixture containing evaporated fuel supplied via the atmosphere line 17, the canister 13, a portion of the purge line 15 to the branch line 19, and the branch line 19 flows in the measurement line 22. Moreover, when the ECU 30 operates the pump 26 in a state where the three-position valve 21 is set at the first position with the selector valve 18 held set at the first position, there is brought about "a second measurement state" where air flows in the measurement line 22.

Moreover, in the measurement line 22, one end of a pressure sensor 24 of pressure measuring means is connected on the downstream side of the restriction 23, that is, between the restriction 23 and the pump 26. The other end of the pressure sensor 24 is open to the atmosphere, and a differential pressure ΔP between the atmospheric pressure and a pressure downstream of the restriction 23 in the measurement line 22 is detected by the pressure sensor 24. The differential pressure ΔP measured by the pressure sensor 24 is outputted to the ECU 30.

The ECU 30 controls the position of a throttle valve 3, the amount of fuel injected from the injector 4, and the opening of the purge valve 16 on the basis of detection values detected by various sensors. For example, the ECU 30 controls theses on the basis of an intake air volume detected by an air flow sensor (not shown) disposed in the intake pipe 2, an intake air pressure detected by an intake air pressure sensor (not shown), an air-fuel ratio detected by an air-fuel ratio sensor 6 disposed in an exhaust pipe, an ignition signal, an engine speed, an engine cooling water temperature, an accelerator position, and the like.

Figure 2:
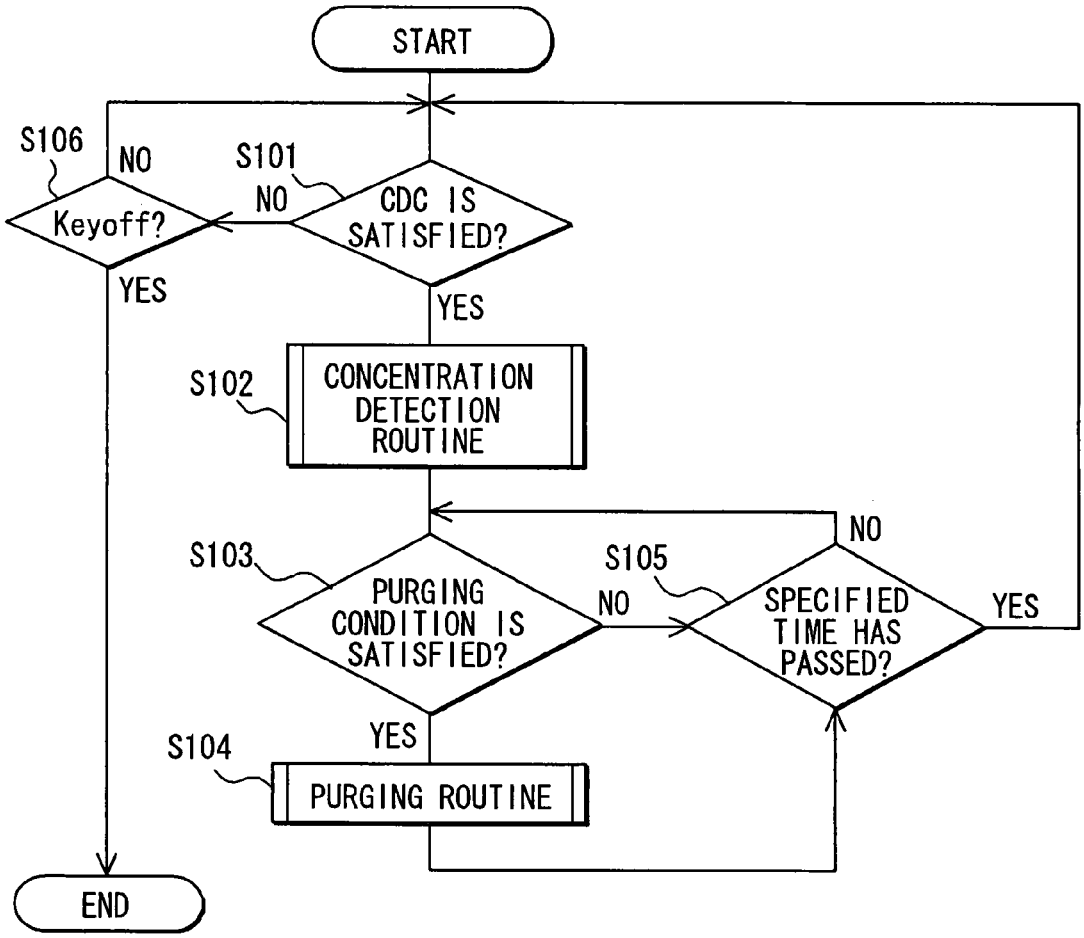
FIG. 2 is a flow chart of purging of evaporated fuel.

FIG. 2 is a flow chart of purging of evaporated fuel performed by the ECU 30. This flow chart is performed when the engine 1 starts to operate. In step S101, it is determined whether a concentration detection condition (CDC) is satisfied. The concentration detection conditions are satisfied when the quantities of state showing an operating state such as engine cooling water temperature, oil temperature, and engine speed are within specified ranges. The concentration detection conditions are set so as to be satisfied earlier than the purging condition is satisfied.

The purging condition is established, for example, when the engine cooling water temperature becomes a specified value Temp1 or more so that the warming-up of the engine is completed. The concentration detection conditions are satisfied while the engine is being warmed up but, for example, the cooling water temperature needs to be a specified value Temp2 lower than the specified temperature Temp1. Moreover, the concentration detection conditions are satisfied also in a period (mainly in the period of deceleration) during which purging of evaporated fuel is stopped with the engine operated. Here, when this evaporation fuel treatment system is applied to a hybrid vehicle, the concentration detection conditions are satisfied also in a period during which the vehicle is run by the motor with the engine stopped.

If determination in step S101 is affirmative, the routine proceeds to step S102 where a concentration detection routine is executed. If determination in step S101 is negative, the routine proceeds to step S106. In step S106, it is determined whether an ignition key is turned off. If determination is negative, the routine returns to step S101. If the ignition key is turned off, this flow is finished.

Figure 3:
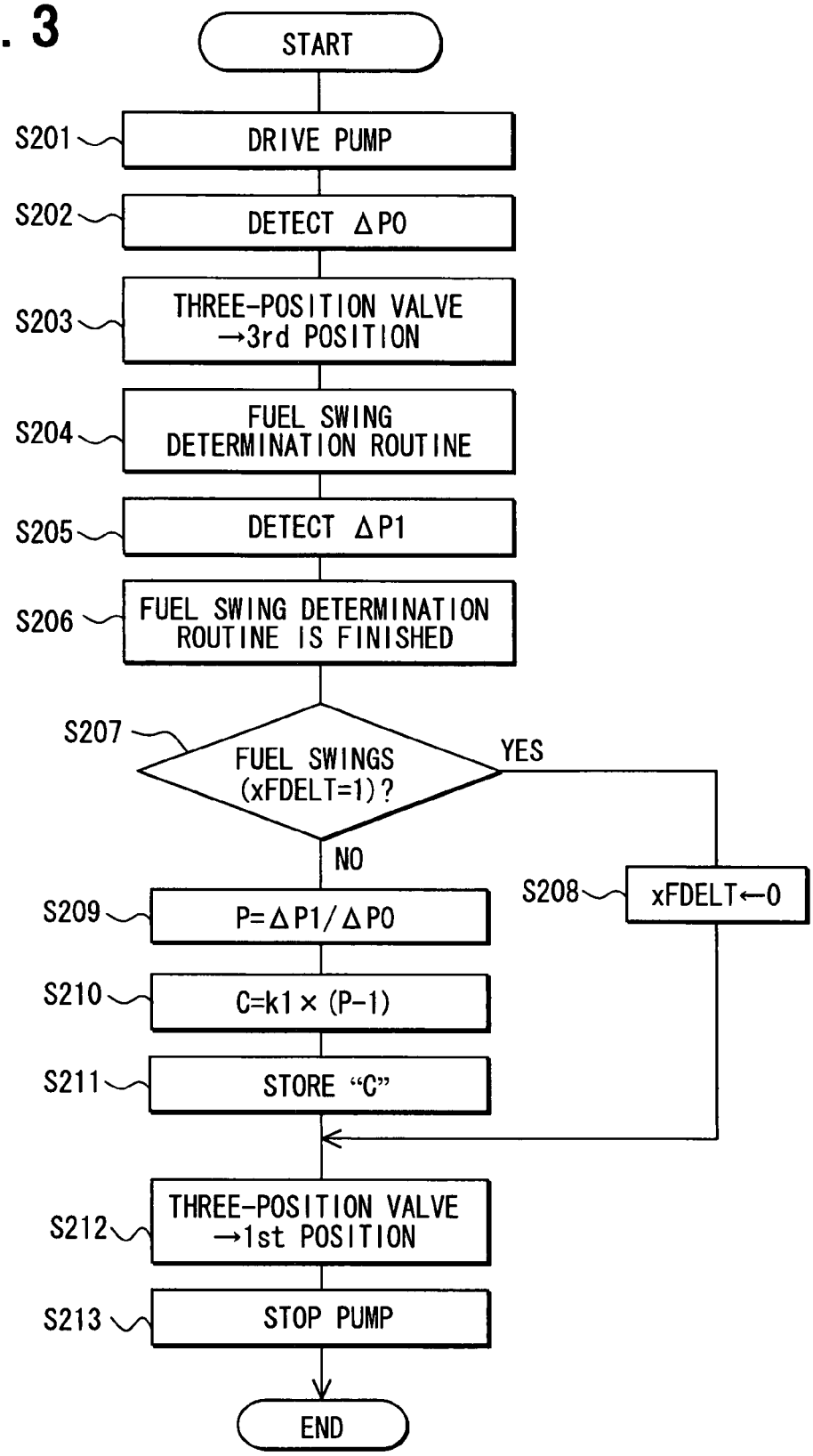
FIG. 3 is a flow chart showing a concentration detection routine in FIG. 2.
Figure 4A:
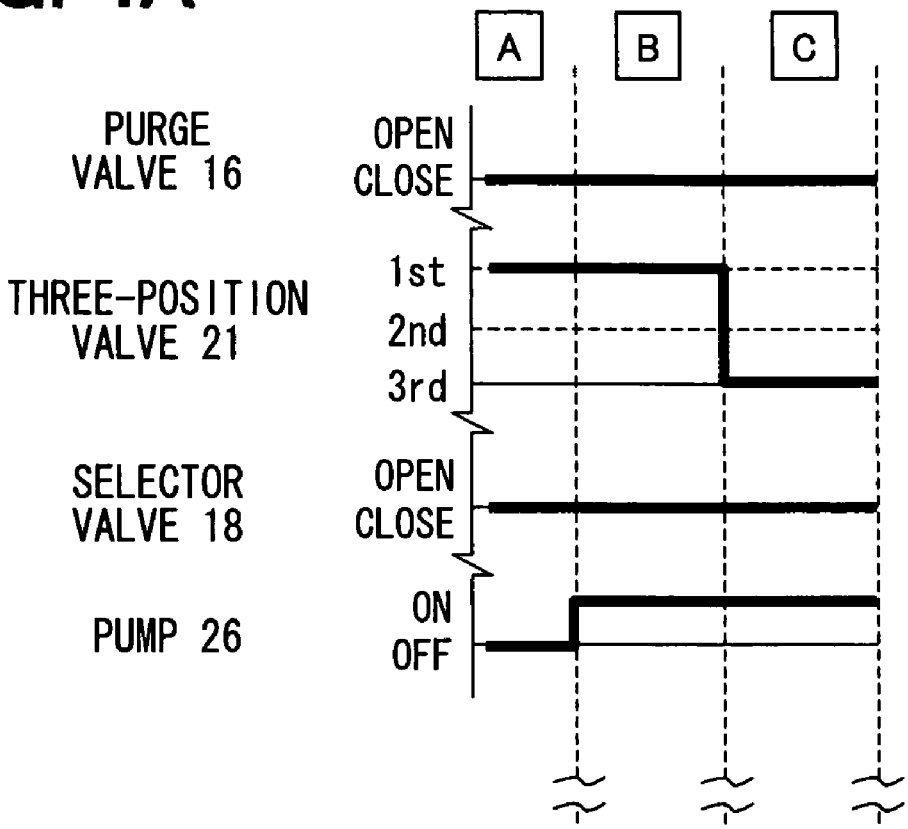
FIG. 4A is a diagram showing the progression of states of respective parts of the system during executing the concentration detection routine.
Figure 4B:
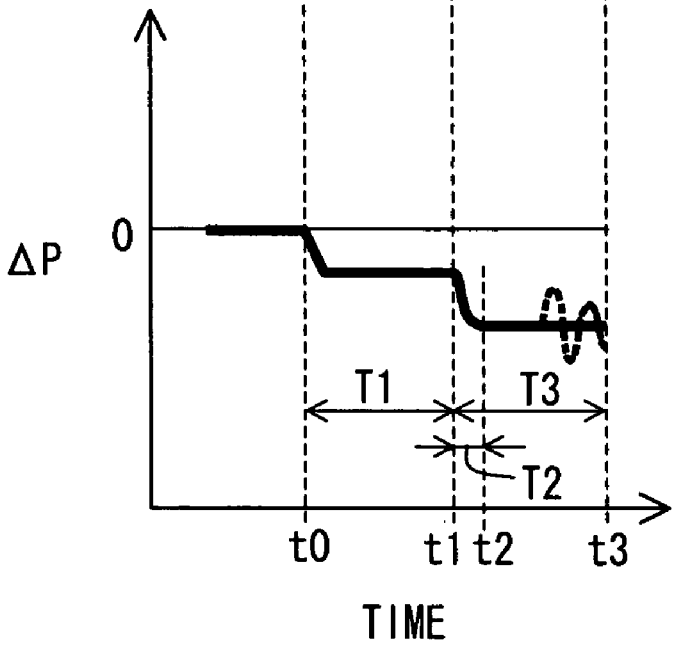
FIG. 4B is a diagram showing a temporal change in a differential pressure ΔP detected by a pressure sensor.

FIG. 3 shows the contents of the concentration detection routine, and FIG. 4A shows the progression of state of respective parts of the system while the concentration detection routine is executed and FIG. 4B shows a temporal change in the differential pressure ΔP detected by the pressure sensor 24.

In the execution of the concentration detection routine, in the initial state, the purge valve 16 is "closed", the three-position valve 21 is set at "the first position", the selector valve 18 is "closed", and the pump 26 is "stopped" (denoted by [A] in FIG. 4A).

Figure 5:
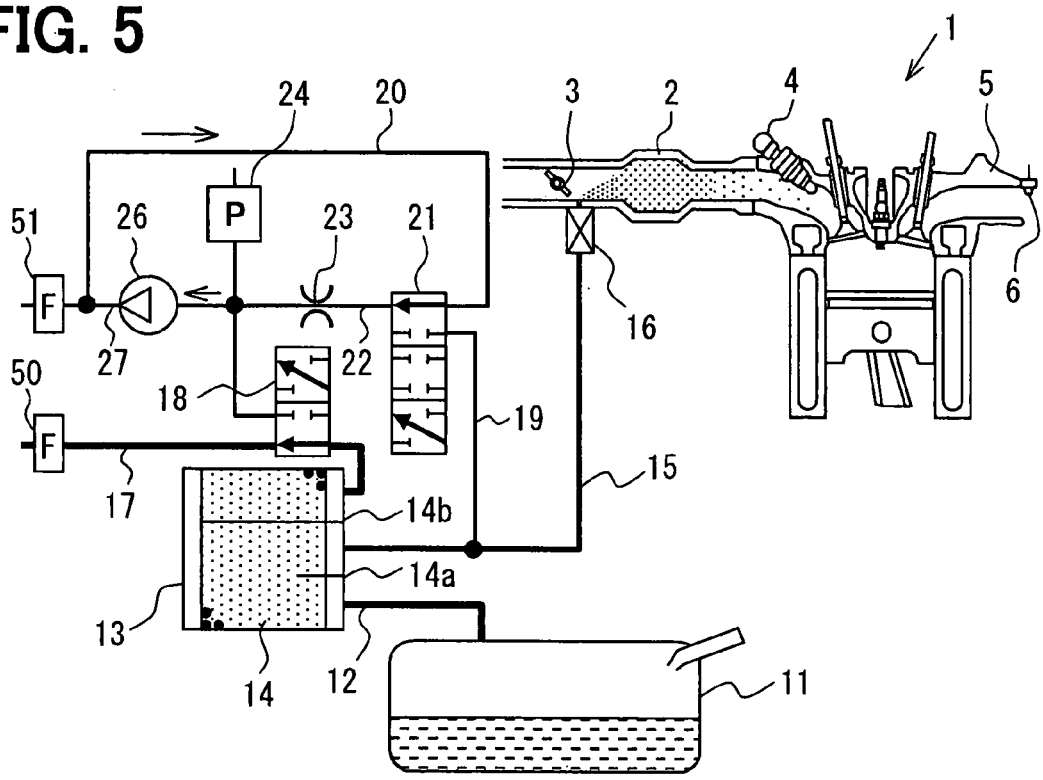
FIG. 5 is a diagram showing a second measurement state.

In step S201, the pump 26 is operated from this state. With this, the state denoted by [B] in FIG. 4A is brought about from timing t0. The communication state of gas at this time is shown by an arrow in FIG. 5. The state shown in FIG. 5 is a second measurement state in which air taken from the air supply line 20 flows through the three-position valve 21 and the restriction 23 of the measurement line 22 and flows into the atmosphere from the discharge line 27.

When air flows through the restriction 23, a pressure loss is caused by the restriction 23, so the differential pressure ΔP is transiently changed after timing t0 and is decreased by the pressure loss caused by the restriction 23.

In step S202, the differential pressure ΔP is detected after the measurement line 22 is switched to the second measurement state, that is, at timing t1 when a specified time T1 elapses after the execution of step S201 (this differential pressure ΔP is referred to as ΔP0). This differential pressure ΔP0 shows the amount of pressure drop of air caused by the restriction 23.

Figure 6:
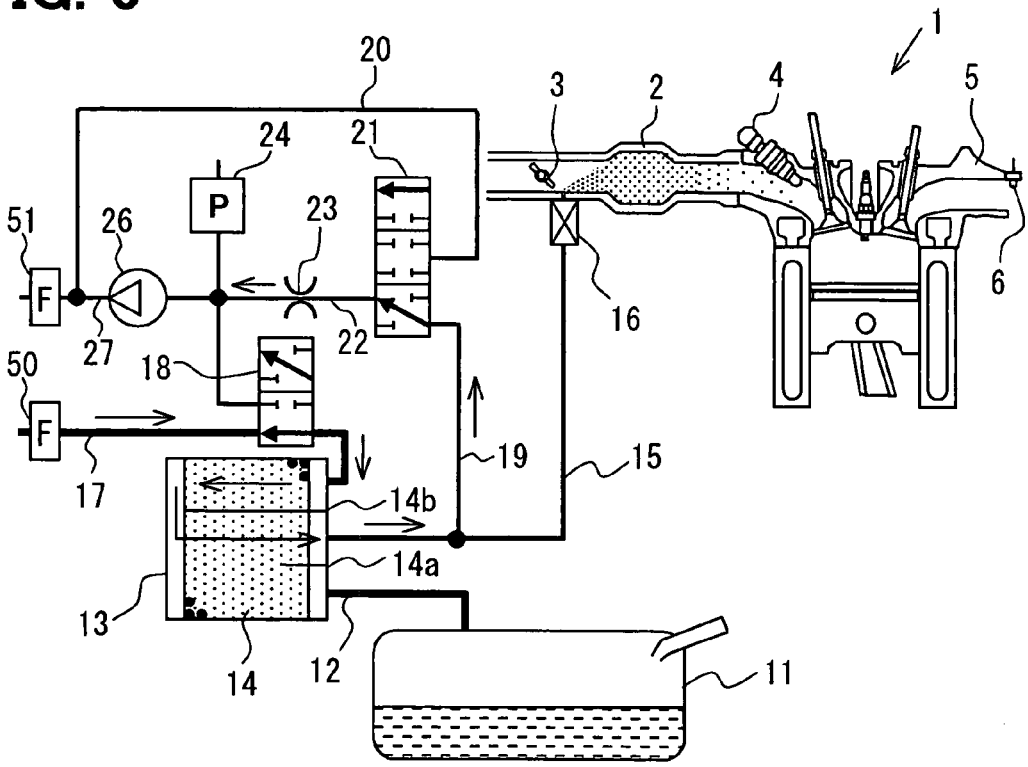
FIG. 6 is a diagram showing a first measurement state.

In step S203, the three-position valve 21 is set at the third position. This operation starts to detect the differential pressure of an air-fuel mixture and brings about a state denoted by [C] in FIG. 4A from timing t1. The communication state of gas at this time is shown in FIG. 6. The state shown in FIG. 6 is a first measurement state. In the first measurement state, air is introduced from the atmosphere line 17 into the canister 13 to produce an air-fuel mixture containing evaporated fuel, and the air-fuel mixture flows through the purge line 15, the branch line 19, the three-position valve 21, and the restriction 23 of the measurement line 22.

Figure 7:
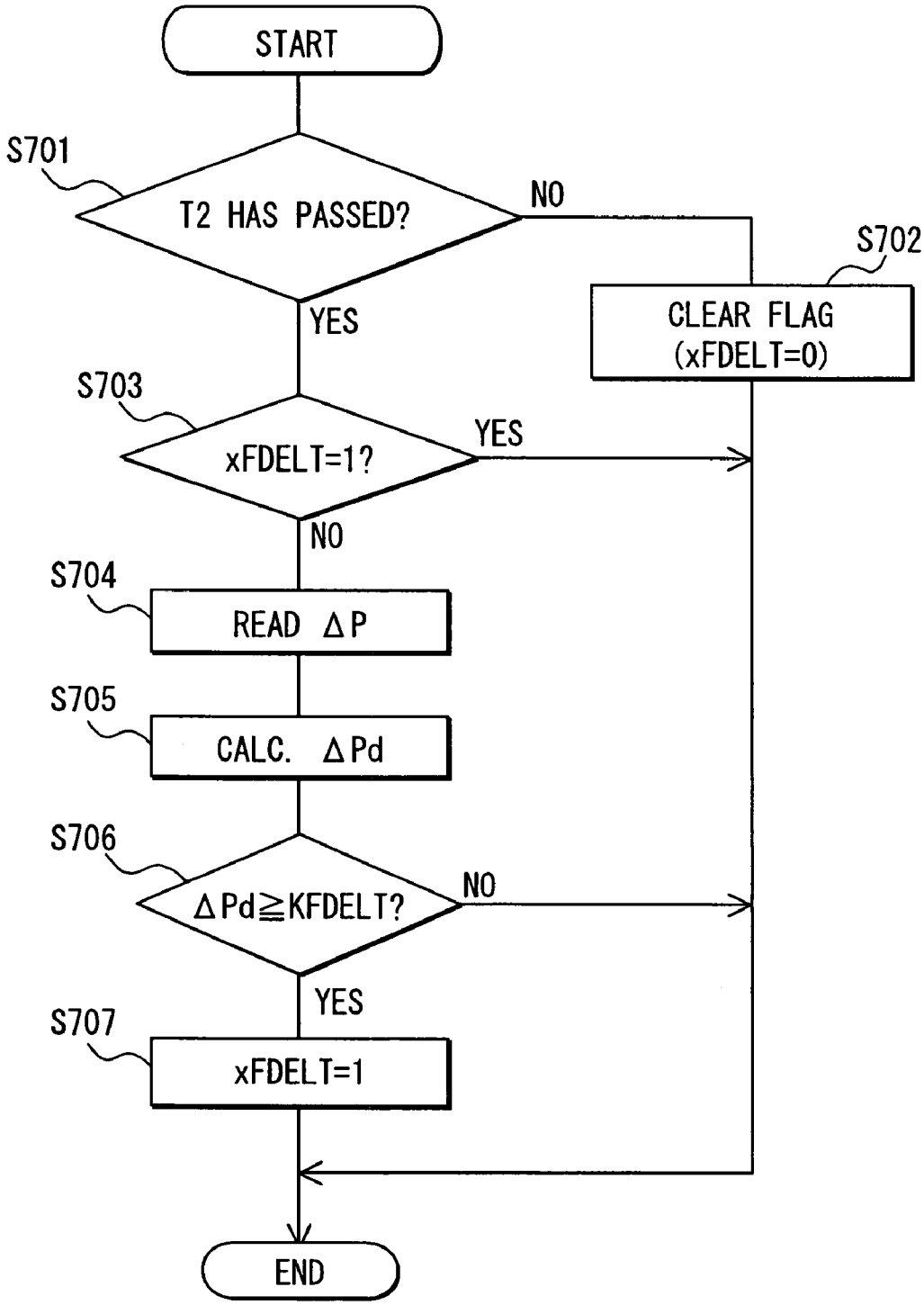
FIG. 7 is a flow chart showing a fuel swing determination routine.

In step S204, a fuel swing determination routine shown in FIG. 7 starts. This fuel swing determination routine is executed repeatedly at specified repeat intervals (for example, at intervals of 16 μsec).

In FIG. 7, first, in step S701, it is determined whether a specified stabilization time T2 (see FIG. 4B) has passed after measurement state is switched, that is, after step S203 in FIG. 3 is executed. This stabilization time T2 is the predetermined time required for temporary pressure fluctuation developed by switching the flow passage of gas to converge.

If the determination in step S701 is negative, the routine proceeds to step S702. In step S702, a fuel swing flag xFDELT is cleared (changed to 0). After the execution of step S702, this routine is finished.

Since determination in step S701 becomes affirmative after timing t2 when the stabilization time T2 passes, the routine proceeds to step S703. In step S703, it is further determined whether it is already determined that fuel swings, that is, whether the fuel swing flag xFDELT is 1. If this determination is affirmative, this routine is finished without executing any operation. If determination in step S703 is negative, the routine proceeds to step S704 in which the detection value ΔP of the pressure sensor 24 is read. In step S705, a differential pressure variation ΔPd is computed by subtracting the differential pressure ΔP read in the last execution of the routine from the differential pressure ΔP read in the last step S704.

In the subsequent step S706, it is determined whether the differential pressure variation ΔPd computed in step S705 is a predetermined fuel swing determination value KFDELT or more. This determination is to determine whether fuel in the fuel tank 11 swings. The reason why whether fuel swings in the fuel tank 11 can be determined on the basis of the magnitude of the variation ΔPd of the differential pressure ΔP caused by the restriction 23 is as follows: this fuel swing determination routine is executed in the first measurement state, and in the first measurement state, the fuel tank 11 communicates with the restriction 23. Hence, when the fuel swings in the fuel tank 11 to vary pressure in the tank, pressure variation is caused also at the restriction 23 communicating with the fuel tank 11.

If determination in step S706 is negative, this routine is finished without executing any operation. On the other hand, if determination in step S706 is affirmative, it is determined that the fuel in the fuel tank 11 swings and the routine proceeds to step S707 in which the fuel swing flag xFDELT is set to 1 and then this routine is finished.

Returning to description of FIG. 3, in step S205, a differential pressure ΔP (hereinafter referred to as ΔP1) is detected at timing t3 after an elapse of a specified time T3 after the measurement state is switched to the first measurement state (after the execution of step S203). The elapse of time T3 is longer than the stabilization time T2 as shown in FIG. 4B. The differential pressure ΔP1 shows the pressure drop of the air-fuel mixture caused by the restriction 23.

When the differential pressure ΔP1 is detected in step S205, the detection of the differential pressure of the air-fuel mixture is finished. While the fuel swing determination routine is executed repeatedly until the differential pressure ΔP1 is detected, when the detection of the differential pressure of the air-fuel mixture is finished, the fuel swing determination routine is finished in step S206.

In the next step S207, it is determined whether it is determined that fuel swings, that is, whether the fuel swing flag xFDELT is 1. As shown by a broken line in FIG. 4B, when the differential pressure ΔP fluctuates between timing t2 and timing t3, the fuel swing flag xFDELT becomes 1 at the timing of determination in step S207, so determination in step S207 becomes affirmative. When determination is affirmative, the routine proceeds to step S208. In step S208, the fuel swing flag xFDELT is cleared to 0 and then routine proceeds to step S212.

If determination in step S207 is negative, the routine proceeds to step S209. Steps 209, 210 are processing as evaporated fuel concentration computation means and compute a differential pressure ratio P by an equation (1) on the basis of two differential pressures ΔP0, ΔP1 obtained in steps S202, 205.

$$P=\Delta P1/\Delta P0 \quad (1)$$

In step S210, an evaporated fuel concentration C is computed by an equation (2) on the basis of the differential pressure ratio P. In the equation (2), k1 is a constant and is stored previously in the ROM of the ECU 30 together with the control program and the like.

$$C=k1\times(P-1)(=(\Delta P1-\Delta P0)/\Delta P0) \quad (2)$$

Because evaporated fuel is heavier than air, purge gas containing evaporated fuel has a larger density. If the number of revolutions of the pump 26 is the same and the flow velocity (flow rate) in the measurement line 22 is the same, as the density becomes larger, a differential pressure caused by the restriction 23 becomes larger by the energy conservation law. As the evaporated fuel concentration C becomes higher, the density becomes large, so that as the evaporated fuel concentration C becomes larger, the differential pressure ratio P becomes larger. As a result, a characteristic curve followed by the evaporated fuel concentration C and the differential pressure ratio P becomes a straight line. The equation (2) expresses this characteristic line and the constant k1 is determined previously by experiment or the like.

In the next step 211, the obtained evaporated fuel concentration C is temporarily stored. In step S212, the three-position valve 21 is returned to the first position and in step S213, the pump 26 is stopped. This state is the same as [A] in FIG. 4A, that is, the measurement state returns to the state before starting the concentration detection routine. Here, steps S203, 205, 207, 208, and 212 correspond to first pressure detection.

Returning to FIG. 2, the concentration detection routine (step S102) is executed and then in step S103, it is determined whether a purging condition is satisfied. The purging condition is determined on the basis of the operating state such as engine water temperature, oil temperature, engine speed, and the like, as is the case with the ordinary evaporated fuel treatment system.

If determination in step S103 is affirmative, purging routine is executed in step S104. In the purging routine, the operating state of the engine is detected and the flow rate of purge gas introduced into the intake pipe 2 is computed on the basis of the detected operating state of the engine. Thus, this step S104 corresponds to flow rate control.

Specifically, this flow rate of purge gas is computed on the basis of a fuel injection amount required in the operating state of the engine such as a present throttle opening, a lower limit value of the fuel injection amount to be controlled by the injector 4, and the pressure of the intake pipe 2. The opening of the purge valve 16 for realizing this flow rate of purge gas is computed on the basis of the evaporated fuel concentration C stored in FIG. 3. The opening of the purge valve 16 is controlled according to the opening computed in this manner until the purge stop condition is satisfied.

Moreover, the three-position valve 21 is switched to the first position in the period during which purging is performed by this purging routine. With this, evaporated fuel is desorbed from the canister 13 and the air-fuel mixture containing the evaporated fuel is purged from the purge line 15 to the intake pipe 2.

When the purging routine is finished, the routine proceeds to step S105. Moreover, if determination in step S103 is negative, the routine directly proceeds to step S105. In step S105, it is determined whether a specified time has passed from the time when the concentration detection routine in FIG. 3 is executed. If determination in step S105 is negative, step S103 is repeatedly executed. If determination in step S105 is affirmative, the routine returns to step S101 and processing for acquiring an evaporated fuel concentration C is performed anew and the evaporated fuel concentration C is updated by the newest value (step S101, S102). The specified time in step S105 is set on the basis of the accuracy of a concentration value required in consideration of a temporal change in the evaporated fuel concentration C.

According to this embodiment described above, it is determined in the fuel swing determination routine (FIG. 7) whether fuel in the fuel tank 11 swings. If it is determined that fuel swings, determination in step S207 in FIG. 3 becomes affirmative and the concentration detection routine is finished without using the differential pressure ΔP1 detected in step S205. That is, the differential pressure ΔP1 detected in step S205 is abandoned. As a result, the computation of the evaporated fuel concentration C by using the differential pressure ΔP1 and the control of flow rate by using the evaporated fuel concentration C are not performed. Thus, it is possible to prevent the flow rate of purge gas introduced into the intake pipe 2 from being controlled on the basis of the differential pressure ΔP which is of insufficient accuracy because fuel swings. As a result, it is possible to control the flow rate of purge gas with higher accuracy.

Figure 8:
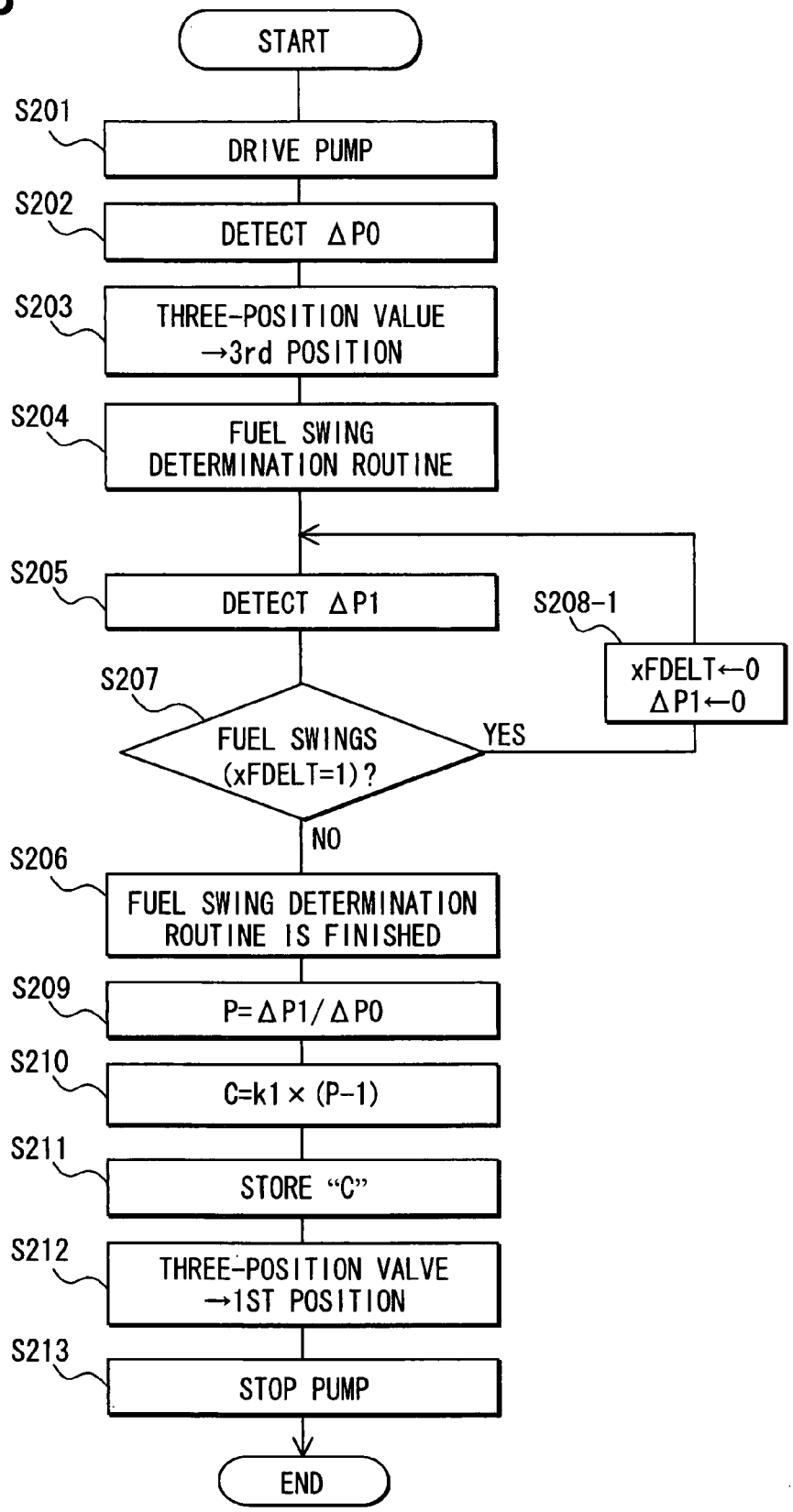
FIG. 8 is a flow chart showing a concentration detection routine executed in a second embodiment.

Next, a second embodiment of the present invention will be described. The second embodiment is different from the first embodiment only in that a concentration detection routine shown in FIG. 8 is executed in place of the concentration detection routine shown in FIG. 3. Moreover, the concentration detection routine shown in FIG. 8 is different from the concentration detection routine shown in FIG. 3 only in that step S206 is executed not between step S205 and step S207 but after step S207 and in that step S208-1 is executed in place of step S208 in FIG. 3.

In the concentration detection routine shown in FIG. 8, even if the differential pressure ΔP1 is detected in step S205, the fuel swing determination routine (FIG. 7) is not finished immediately but it is first determined whether it is determined in step S207 that fuel swings. If this determination is affirmative, that is, if fuel does not swing, the fuel swing determination routine is finished in step S206 and then the same step S209 and its subsequent steps as in FIG. 3 are executed.

On the other hand, if it is determined in step S207 that fuel swings, step S208-1 is executed. In step S208-1, the fuel swing flag xFDELT is cleared to 0 and the differential pressure ΔP1 is cleared to 0. Then, the routine returns to step s205 after this processing is executed.

In step S205 after the execution of step S208-1, the differential pressure ΔP1 is again detected and the differential pressure ΔP1 to be used in the following processing is updated by the newly detected differential pressure ΔP1. In the next step S207, it is again determined whether the fuel swing flag xFDELT is 1. Since the fuel swing flag xFDELT is cleared to 0 in the last step S208-1, if it is not again determined by the fuel swing determination routine executed in parallel (FIG. 7) that fuel swings before the differential pressure ΔP1 is detected in step S205 following step 208-1, determination in step S207 becomes negative this time and the routine proceeds to step S206. On the other hand, because the fuel swings still, even if the fuel swing flag xFDELT is once cleared to 0 in step S208-1, if it is determined that fuel swings by the fuel swing determination routine executed in parallel, determination in step S207 becomes affirmative again and hence the routine proceeds to step S208-1.

As a result, steps S205, S207, and S208-1 are repeatedly executed until fuel stops to swing and when the fuel stops to swing, the routine proceeds to step S206 and its subsequent steps.

In this second embodiment, steps S203, S205, S207, S208-1, and S212 correspond to first pressure detection. After the differential pressure ΔP1 is detected in step S205, step S207 is executed to determine whether fuel swings. If it is determined that fuel swings, step S205 is executed again to immediately detect a differential pressure ΔP1 again and the differential pressure ΔP1 detected at the time when fuel swung is updated by the new detected differential pressure ΔP1.

Thus, it is possible to prevent the flow rate of purge gas introduced into the intake pipe 2 from being controlled on the basis of the differential pressure ΔP which is of insufficient accuracy because fuel swings. As a result, it is possible to control the flow rate of purge gas with higher accuracy. Moreover, the differential pressure ΔP1 is again detected immediately, so a new differential pressure ΔP1 can quickly be acquired. Thus, it is possible to quickly perform the computation of the evaporated fuel concentration C and the control of the flow rate of purge gas based on the evaporated fuel concentration C.

Figure 9:
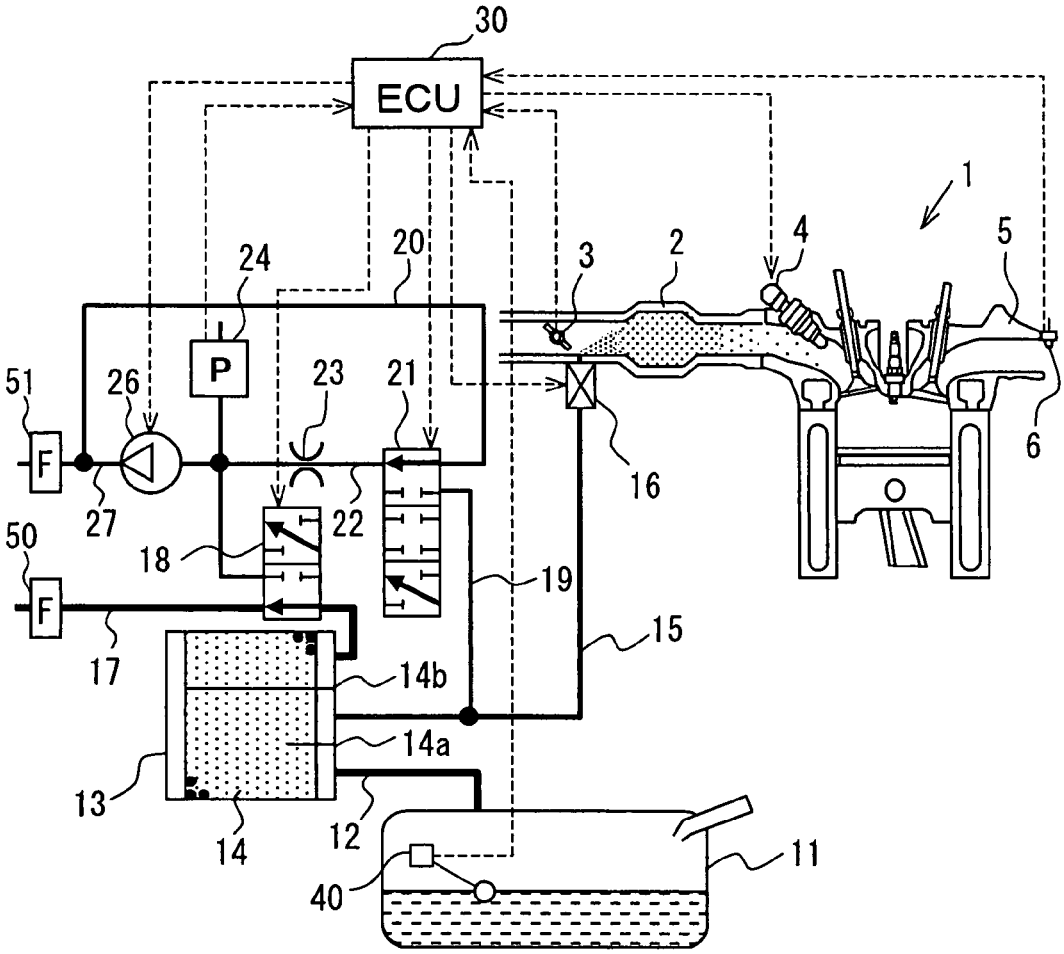
FIG. 9 is a construction diagram of an evaporated fuel treatment system according to a third embodiment.

Next, a third embodiment of the present invention will be described. FIG. 9 is a construction diagram of an evaporated fuel treatment system of the third embodiment. The evaporated fuel treatment system of the third embodiment is different from FIG. 1 in that the output value of a remaining fuel amount level sensor 40 disposed in the fuel tank 11 is supplied to the ECU 30.

Figure 10:
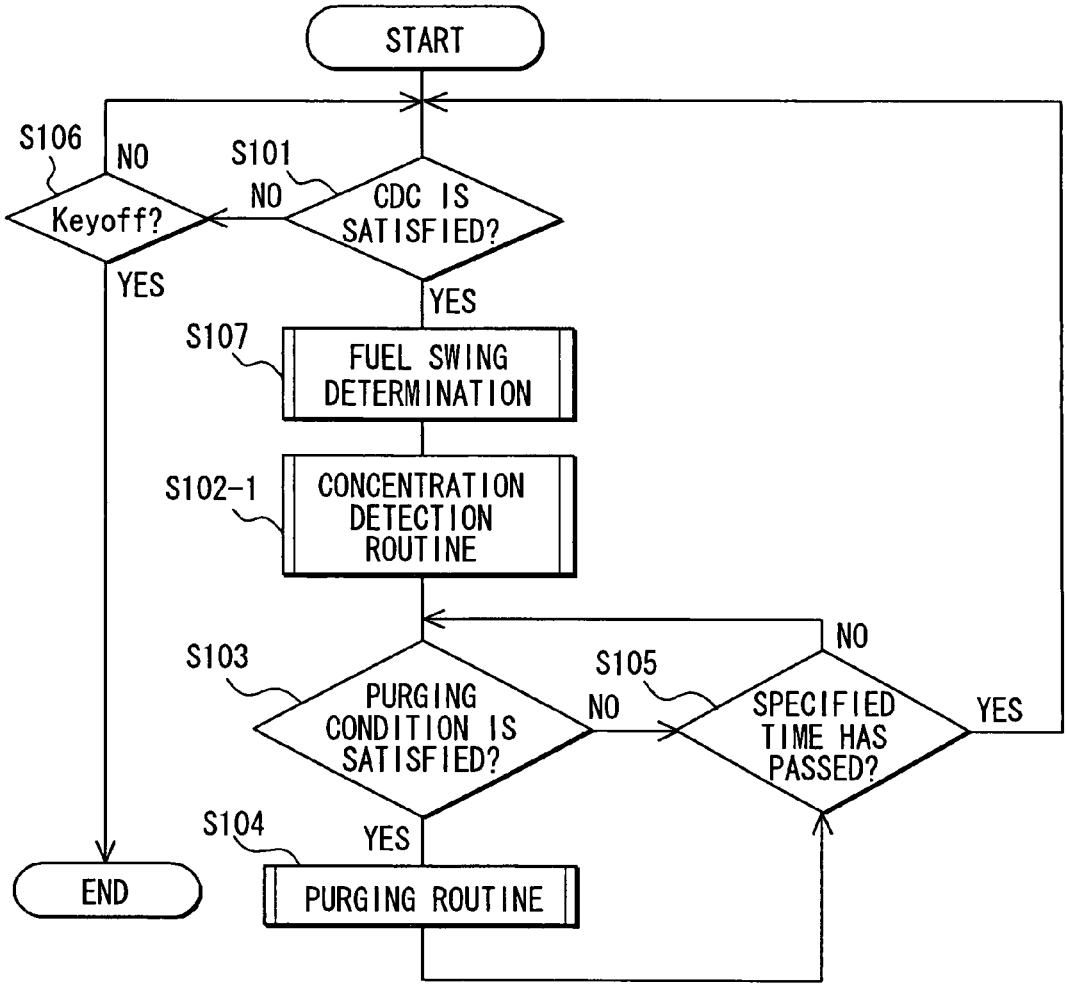
FIG. 10 is a routine executed in place of a routine in FIG. 2 in the third embodiment.

FIG. 10 is a routine executed in the third embodiment in place of the routine in FIG. 2. The routine in FIG. 10 is different from the routine in FIG. 2 in that a concentration detection routine shown in FIG. 11 is executed as step S102-1 in place of the concentration detection routine in step S102 and in that fuel swing determination processing (step S107) corresponding to fuel swing determination means is executed before executing the concentration detection routine in step S102-1.

In fuel swing determination processing in step S107, if the variation of the output value of the remaining fuel amount level sensor 40 for a relatively short specified swing determination time exceeds a predetermined reference value, it is determined that fuel swings and the fuel swing flag xFDELT is set to 1. On the other hand, if the variation is the reference value or less, it is determined that fuel does not swing and the fuel swing flag xFDELT is set to 0.

Thus, if it is determined in step S101 that the concentration detection conditions are satisfied, the fuel swing determination processing in step S107 is executed. Then, it is determined whether fuel in the fuel tank 11 swings and then the concentration detection routine in step S102-1 is executed.

Figure 11:
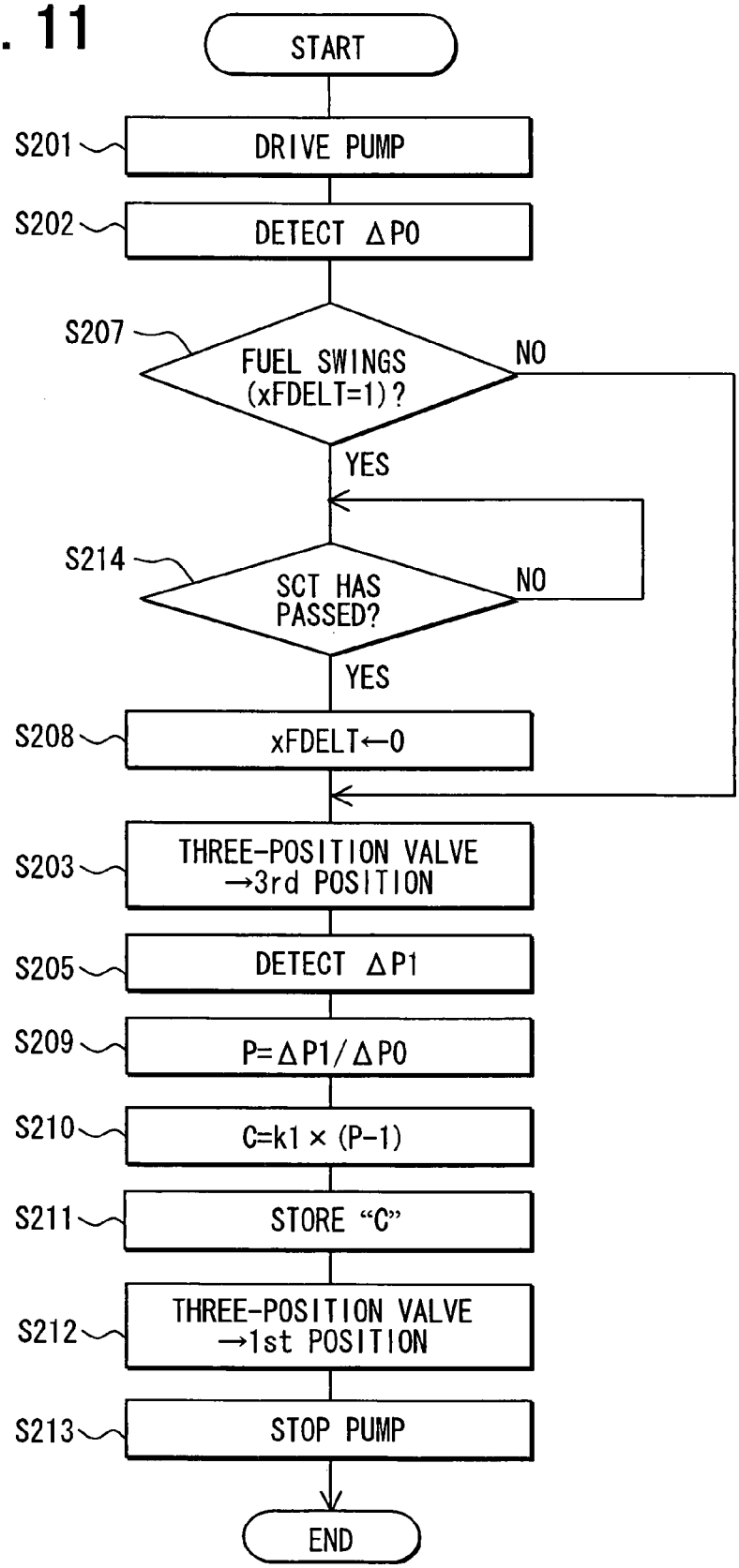
FIG. 11 is a flow chart showing a concentration detection routine executed in the third embodiment.

The concentration detection routine in step S102-1 is shown in detail in FIG. 11. In the concentration detection routine in step S102-1, because fuel swing determination is already made before executing this concentration detection routine, step S207 is executed before starting the operation of detecting the differential pressure of the air-fuel mixture (step S203) to determine whether fuel swings, that is, whether the fuel swing flag xFDELT is 1. If this determination is negative, step S203 is executed immediately to start the operation of detecting the differential pressure of the air-fuel mixture.

On the other hand, if determination in step S207 is affirmative, step S214 is executed. In this step S214, it is determined whether a swing convergence time (SCT) has passed after it is determined in step S107 in FIG. 10 that fuel swings. This swing convergence time (SCT) is the time required for fuel in the fuel tank 11 once swung by some reason to be sufficiently stabilized and is set previously by experiment. If determination in step S214 is negative, the determination in step S214 is repeatedly made. Then, if the swing convergence time passes and the determination in step S214 becomes affirmative, step S208 is executed to clear the fuel swing flag xFDELT and then step S203 is executed.

In the third embodiment, it can be thought at the time of executing step S203 that fuel does not swing. Thus, after the operation of detecting the differential pressure of the air-fuel mixture in step S203, a differential pressure ΔP1 is detected in step S205 without determining whether fuel swings, and in step S209, a differential pressure ratio P is computed by the use of the differential pressure ΔP1. The processing after executing step S209 is the same as in FIG. 3.

According to the third embodiment, the fuel swing determination processing (in step S107 in FIG. 10) is executed before step S203 in which the operation of detecting the differential pressure of the air-fuel mixture is started, and if it is determined that the fuel swings, the operation of detecting the differential pressure of the air-fuel mixture is not started. Thus, it is possible to prevent the differential pressure ΔP1 from being detected when the differential pressure ΔP1 is of insufficient accuracy because the fuel swings. For this reason, it is possible to prevent the amount of flow rate of purge gas from being controlled on the basis of the differential pressure ΔP1 of insufficient accuracy. As a result, it is possible to control the flow rate of purge gas with higher accuracy.

Moreover, according to the third embodiment, it is determined whether the fuel swings before starting the operation of detecting the differential pressure of the air-fuel mixture. Thus, the operation of detecting the differential pressure of the air-fuel mixture is not started uselessly in the period during which the fuel swings, either.

Moreover, it is determined that the fuel stops swinging from the fact that a specified swing convergence time passes from the time when it is determined that the fuel swings. Thus, it is possible to reduce the number of executions of the fuel swing determination processing.

Next, a fourth embodiment of the present invention will be described. The fourth embodiment is different from the third embodiment in that the concentration detection routine in FIG. 12 is executed in step S102-1 in FIG. 9.

Figure 12:
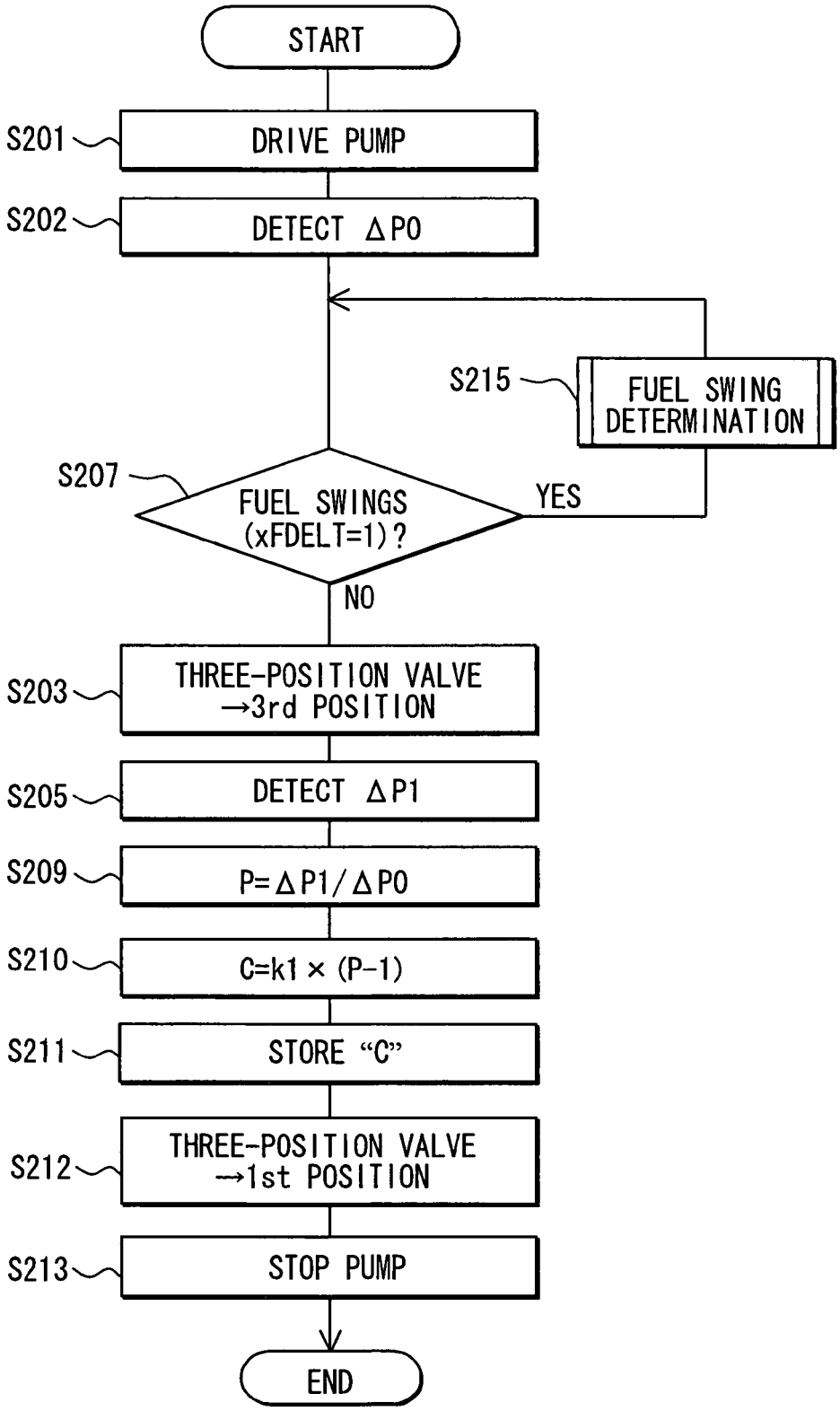
FIG. 12 is a flow chart showing a concentration detection routine executed in a fourth embodiment.

The concentration detection routine in FIG. 12 is the same as in FIG. 11 in that step S207 is executed following step S202 to determine whether fuel swings. Moreover, the concentration detection routine in FIG. 12 is the same as in FIG. 11 also in that if determination in step S207 is negative, immediately, step S203 and its following steps are executed. On the other hand, the concentration detection routine in FIG. 12 is different from the concentration detection routine in FIG. 11 in processing when determination in step S207 is affirmative.

If determination in step S207 is affirmative, the fuel swing determination processing is executed in step S215. The processing in this step S215 is the same as step S107 in FIG. 10. If this step S215 is executed and it is determined that fuel still swings, the fuel swing flag xFDELT is held set to 1. On the other hand, if it is determined that fuel does not already swing, the fuel swing flag xFDELT is cleared to 0. After executing step S215, determination in step S207 is repeatedly performed.

In the fourth embodiment, it is repeatedly determined whether fuel swings (step S215) and the operation of detecting the differential pressure of the air-fuel mixture is not performed until it is determined that fuel does not swing. Thus, it is possible to perform the operation of detecting the differential pressure of the air-fuel mixture after fuel surely stops swinging.

While the preferred embodiments of the present invention have been described above, the present invention is not limited to the above embodiments but the following embodiments are also included within the technical scope of the present invention. Further, various modifications other than the embodiments described below may be made without departing from the spirit and scope of the present invention.

For example, in the above embodiments, the fuel tank 11 does not communicate with the restriction 23 in the state in which the differential pressure ΔP0 is detected. However, air may be flowed through a specified restriction in the state in which the fuel tank 11 communicates with the restriction to form a second measurement state and the amount of change in the pressure of air caused by the restriction (that is, differential pressure ΔP0) may be detected in this second measurement state.

When the differential pressure ΔP0 is detected in the state in which the fuel tank 11 communicates with the specified restriction, if it is determined that fuel swings in a period during which the differential pressure ΔP0 is detected, it is preferable that the detected differential pressure ΔP0 is abandoned and that the differential pressure is immediately re-detected.

Figure 13:
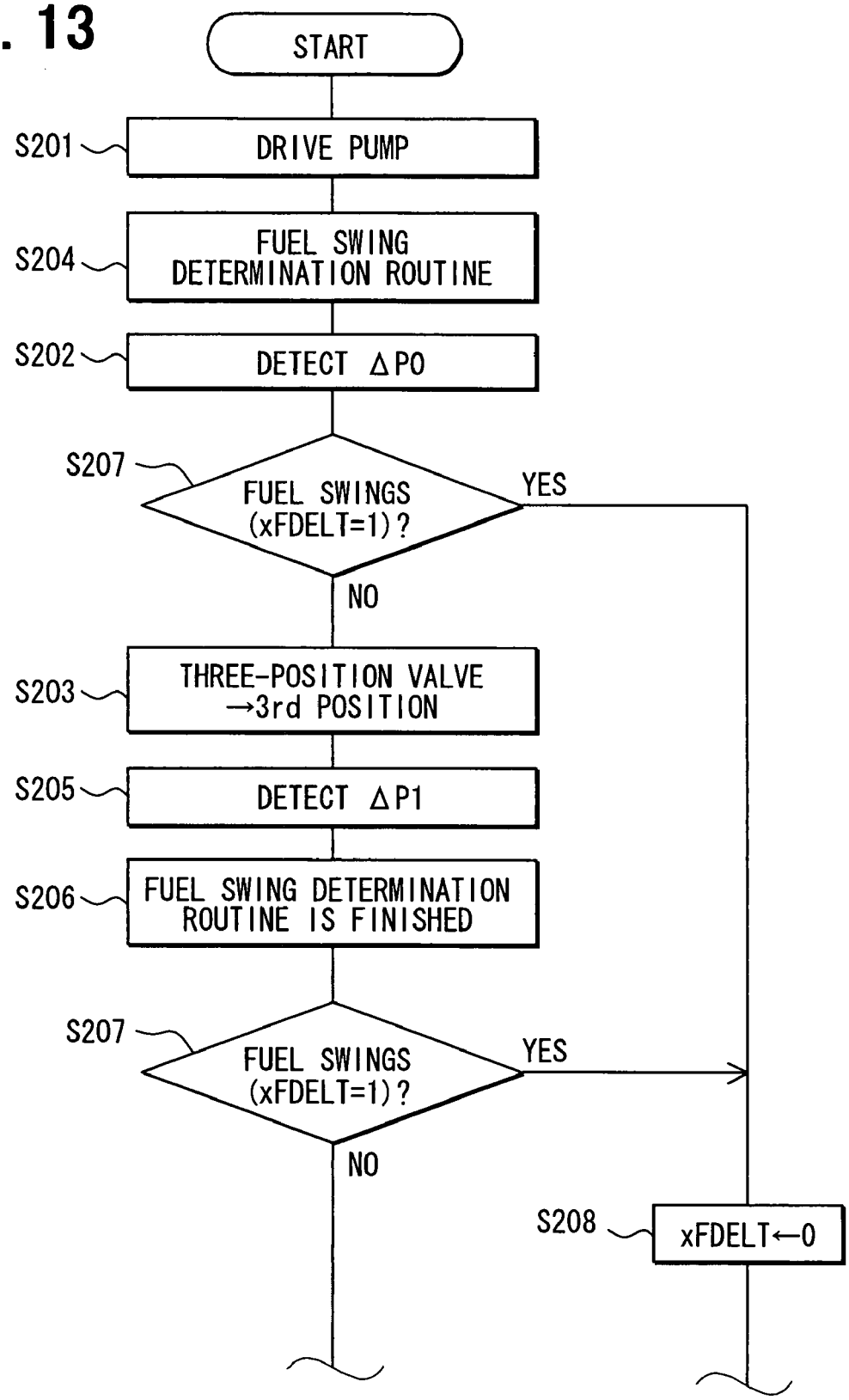
FIG. 13 is a flow chart showing processing of abandoning a differential pressure when it is determined that fuel swings in a period during which the differential pressure is detected.

In FIG. 13, step S204 (fuel swing determination routine) is executed before step S202 in FIG. 3 and step S207 is additionally executed also between step S202 and step S203. In FIG. 13, also if it is determined that fuel swings in step S207 following step S202, the fuel swing flag xFDELT is cleared in step S208 and then the routine is finished.

Figure 14:
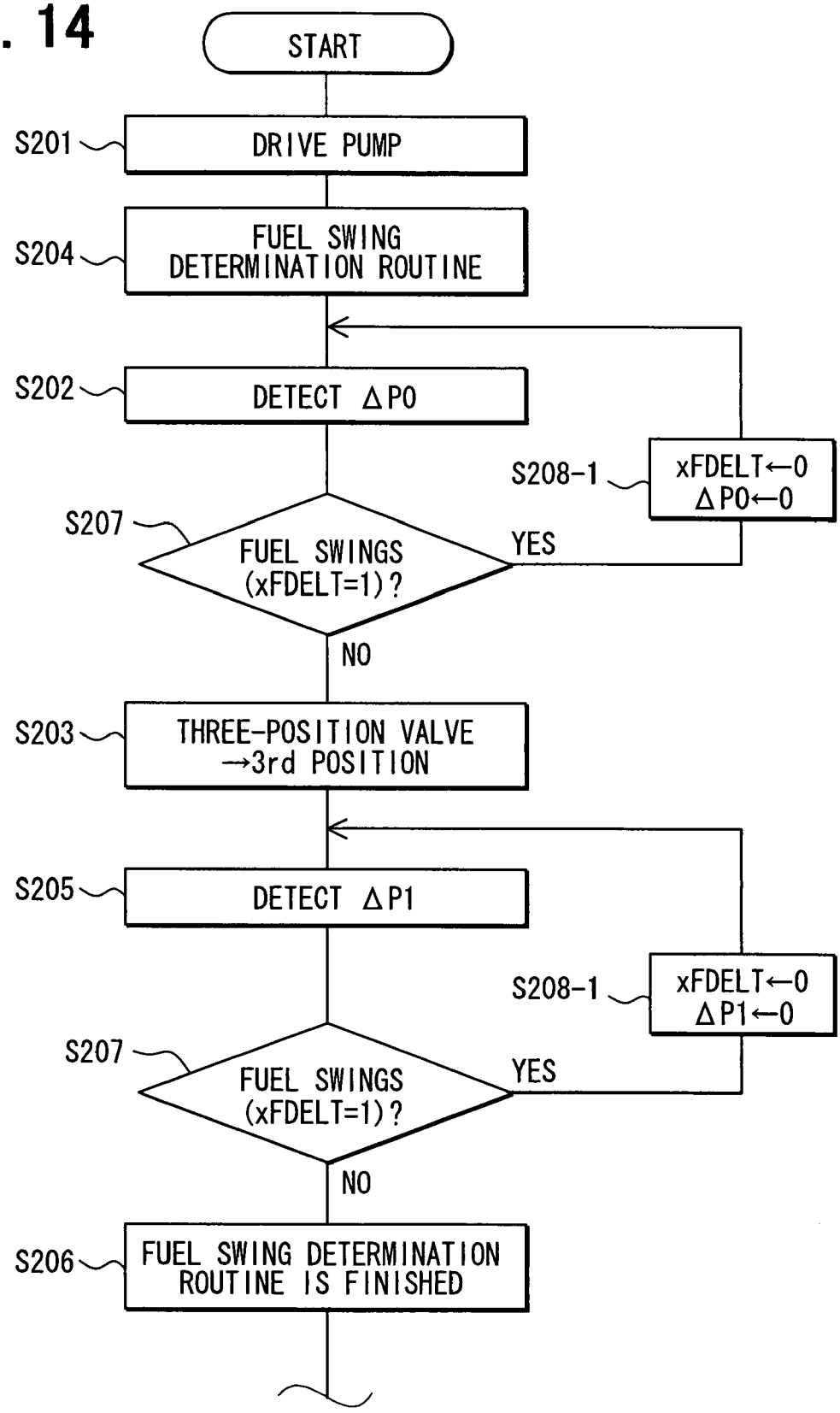
FIG. 14 is a flow chart showing processing of re-detecting a differential pressure when it is determined that fuel swings in a period during which the differential pressure is detected.

In FIG. 14, step S204 (fuel swing determination routine) is executed before step S202 in FIG. 8 and step S207 is additionally executed also between step S202 and step S203, and step S208-1 is additionally executed in association with step S207. In FIG. 14, also if it is determined that fuel swings in step S207 following step S202, just as with case in which it is determined that fuel swings in step S207 following step S205, the fuel swing flag xFDELT and the differential pressure ΔP0 are cleared in step S208-1 and then the differential pressure ΔP0 is detected immediately again.

Moreover, if the differential pressure ΔP0 is detected in the state in which the fuel tank 11 communicates with the specified restriction and it is determined whether fuel swings on the basis of the output value of the fuel level sensor 40, it may also be determined that fuel swings before detecting the differential pressure ΔP0. If it is determined that fuel swings, the operation of detecting the differential pressure ΔP0 may be not performed until a specified swing convergence time passes. Alternatively, it may be repeatedly determined whether fuel swings and the operation of detecting the differential pressure ΔP0 may be not performed until it is determined that fuel does not swing. In the former case, for example, in FIG. 11, steps S207, S214, and S208 are executed before step S202. In the latter case, for example, in FIG. 12, steps S207 and S215 are executed before step S202.

Moreover, in the third and fourth embodiments, it is determined whether fuel swings on the basis of the amount of change in the output value of the remaining fuel amount level sensor 40. If the vehicle is provided with an acceleration sensor, however, it may be determined whether fuel swings on the basis of the output value of the acceleration sensor. This is because it can be thought that since the acceleration sensor can detect the vehicle swinging, when the acceleration sensor can detect the vehicle swinging, fuel is also swinging.

Moreover, in the above embodiments, the differential pressure ΔP1 of the air-fuel mixture and the differential pressure ΔP0 of the air are detected by the common restriction 23, but these differential pressures ΔP1, ΔP0 may be detected by the use of different restrictions. Further, since the variation of the differential pressure ΔP0 is not so large, a previously stored value may be used as the differential pressure ΔP0. Alternatively, the differential pressure ΔP0 may be also determined from a specified computation equation on the basis of the atmospheric temperature and the atmospheric pressure.

What is claimed is:

1. An evaporated fuel treatment system for an internal combustion engine that introduces evaporated fuel in a fuel tank into a canister via an evaporated fuel passage to make an adsorbing material in the canister adsorb the evaporated fuel temporarily and purges the evaporated fuel adsorbed by the adsorbing material into an intake pipe of the combustion engine when the internal combustion engine is operated, the system comprising:

a first pressure detection means for detecting an amount of change in pressure of an air-fuel mixture caused by a restriction in a first measurement state in which the fuel tank, the canister, and the restriction communicates with each other and in which the air-fuel mixture flows through the restriction, the air-fuel mixture containing evaporated fuel purged from the canister;

a flow rate control means for controlling a flow rate of the air-fuel mixture introduced into the intake pipe from the canister on a basis of an amount of change in pressure detected by the first pressure detection means and an amount of change in pressure of an air flowing through the restriction; and a fuel swing determination means for determining whether a fuel in the fuel tank swings, wherein when the fuel swing determination means determines that the fuel swings, the flow rate control means stops the control of a flow rate of the air-fuel mixture based on an amount of change in pressure of the air-fuel mixture.

2. The evaporated fuel treatment system for an internal combustion engine as claimed in claim 1, wherein the fuel swing determination means successively determines whether the fuel swings in a period during which the first pressure detection means detects an amount of change in pressure, and after the first pressure detection means finishes detecting an amount of change in pressure, the first pressure detection means determines whether the fuel swing determination means determines that the fuel swings in a period during which the first pressure detection means detects an amount of change in pressure, and the first pressure detection means abandons a detected amount of change in pressure if the fuel swing determination means determines that the fuel swings.

3. The evaporated fuel treatment system for an internal combustion engine as claimed in claim 1, wherein the fuel swing determination means determines whether the fuel swings in a period during which the first pressure detection means detects an amount of change in pressure, and after the first pressure detection means finishes detecting an amount of change in pressure, the first pressure detection means determines whether the fuel swing determination means determines that fuel swings in a period during which the first pressure detection means detects an amount of change in pressure, and the first pressure detection means detects a detected amount of change in pressure again if the fuel swing determination means determines that the fuel swings.

4. The evaporated fuel treatment system for an internal combustion engine as claimed in claim 1, wherein the fuel swing determination means determines whether the fuel swings before the first pressure detection means detects an amount of change in pressure.

5. The evaporated fuel treatment system for an internal combustion engine as claimed in claim 4, wherein when the fuel swing determination means determines that the fuel swings, the first pressure detection means stops an operation of measuring pressure until a specified time passes.

6. The evaporated fuel treatment system for an internal combustion engine as claimed in claim 4, wherein when the fuel swing determination means determines that the fuel swings, the first pressure detection means stops an operation of measuring pressure until the fuel swing determination means determines that no fuel swings.

7. The evaporated fuel treatment system for an internal combustion engine as claimed in claim 1, further comprising a second pressure detection means for detecting an amount of change in pressure of an air caused by a restriction in a second measurement state in which the air flows through the restriction and in which the restriction communicates with the fuel tank, wherein when the fuel swing determination means determines that the fuel swings, the flow rate control means stops the control of a flow rate based on an amount of change in pressure of the air detected by the second pressure detection means.

8. The evaporated fuel treatment system for an internal combustion engine as claimed in claim 7, wherein the fuel swing determination means determines whether the fuel swings in a period during which the second pressure detection means detects an amount of change in pressure, and after the second pressure detection means finishes detecting an amount of change in pressure, the second pressure detection means determines whether the fuel swing determination means determines that the fuel swings in a period during which the second pressure detection means detects an amount of change in pressure, and the second pressure detection means abandons the detected amount of change in pressure if the fuel swing determination means determines that the fuel swings.

9. The evaporated fuel treatment system for an internal combustion engine as claimed in claim 7, wherein the fuel swing determination means successively determines whether the fuel swings in a period during which the second pressure detection means detects an amount of change in pressure, and after the second pressure detection means finishes detecting an amount of change in pressure, the second pressure detection means determines whether the fuel swing determination means determines that the fuel swings in a period during which the second pressure detection means detects an amount of change in pressure, and the second pressure detection means detects an amount of change in pressure again if the fuel swing determination means determines that the fuel swings.

10. The evaporated fuel treatment system for an internal combustion engine as claimed in claim 7, wherein the fuel swing determination means determines whether the fuel swings before the second pressure detection means detects an amount of change in pressure.

11. The evaporated fuel treatment system for an internal combustion engine as claimed in claim 10, wherein when the fuel swing determination means determines that the fuel swings, the second pressure detection means stops an operation of measuring pressure until a specified time passes.

12. The evaporated fuel treatment system for an internal combustion engine as claimed in claim 10, wherein when the fuel swing detection means determines that the fuel swings, the second pressure detection means stops an operation of measuring pressure until the fuel swing determination means determines that no fuel swings.

13. The evaporated fuel treatment system for an internal combustion engine as claimed in claim 2, wherein the fuel swing determination means determines whether the fuel swings on a basis of a temporal change in an amount of change in pressure of gas caused by the restriction.

14. The evaporated fuel treatment system for an internal combustion engine as claimed in claim 1, wherein the fuel swing determination means determines whether the fuel swings on a basis of an amount of change in an output value of a fuel level sensor disposed in the fuel tank.

15. The evaporated fuel treatment system for an internal combustion engine as claimed in claim 1, wherein the fuel swing determination means determines whether fuel swings on a basis of an output value of an acceleration sensor mounted in a vehicle.

16. The evaporated fuel treatment system for an internal combustion engine as claimed in claim 1, further comprising:

a measurement passage having a restriction;

a gas flow generation means for generating a gas flow passing through the restriction disposed in the measurement passage;

a pressure measurement means for measuring an amount of change in pressure caused by the restriction when the gas flow generation means generates a gas flow;

a measurement passage switching means for switching the measurement passage between in the first measurement state and in the second measurement state; and an evaporated fuel concentration computation means for computing an evaporated fuel concentration of an air-fuel mixture introduced into the intake pipe from the canister on a basis of an amount of change in pressure detected by the first pressure detection means and an amount of change in pressure detected by the second pressure detection means, wherein the flow rate control means controls a flow rate of an air-fuel mixture introduced into the intake pipe from the canister on a basis of an evaporated fuel concentration of the air-fuel mixture computed by the evaporated fuel concentration computation means.

* * * * *